US008224016B2

(12) United States Patent
Song

(10) Patent No.: US 8,224,016 B2
(45) Date of Patent: Jul. 17, 2012

(54) ELECTROACOUSTIC TRANSDUCER HAVING MULTI-CHANNEL DIAPHRAGM AND HEARING AID USING THE SAME

(76) Inventor: Ci-Moo Song, Sungnam-Si (KR)

( * ) Notice: Subject to any disclaimer, the term of this patent is extended or adjusted under 35 U.S.C. 154(b) by 965 days.

(21) Appl. No.: 12/294,614

(22) PCT Filed: Oct. 13, 2006

(86) PCT No.: PCT/KR2006/004114

§ 371 (c)(1),
(2), (4) Date: Sep. 25, 2008

(87) PCT Pub. No.: WO2007/111405

PCT Pub. Date: Oct. 4, 2007

(65) Prior Publication Data

US 2009/0232338 A1 Sep. 17, 2009

(30) Foreign Application Priority Data

Mar. 27, 2006 (KR) ..... 10-2006-0027236

(51) Int. Cl.
*H04R 7/06* (2006.01)

(52) U.S. Cl. ..... 381/424; 381/300; 381/312; 381/332; 381/335; 381/423; 381/431; 381/186; 381/190; 181/163; 181/164; 181/173; 181/174

(58) Field of Classification Search ..... 381/300, 381/312, 322, 332, 335, 423, 424, 431, 162, 381/186, 190; 181/163, 164, 173, 174
See application file for complete search history.

(56) References Cited

FOREIGN PATENT DOCUMENTS

| | | |
|---|---|---|
| JP | 62-045300 | 2/1987 |
| JP | 02-265400 | 10/1990 |
| JP | 2005-229227 | 8/2005 |

*Primary Examiner* — Kenneth Parker
*Assistant Examiner* — John Lin
(74) *Attorney, Agent, or Firm* — IPLA P.A.; James E. Bame

(57) ABSTRACT

An object of the present invention is to provide an electroacoustic transducer having a multi-channel diaphragm, and a hearing aid using the electroacoustic transducer, in which a plurality of channels having different resonant frequencies is formed in the diaphragm using MEMS technology, thus more closely approximating the different audible frequency characteristics of respective persons. The present invention provides an electroacoustic transducer provided with a multi-channel diaphragm. The electroacoustic transducer includes a diaphragm (110) and signal conversion units (120). The diaphragm is provided with respective channels having different resonant frequencies. The signal conversion units are attached to surfaces channels of the channels, or are arranged to be spaced apart from the surfaces of the channels at a predetermined interval, the signal conversion units converting vibration received from the channels into acoustic signals, or transmitting acoustic signals to the diaphragm and converting the acoustic signals into vibration.

18 Claims, 4 Drawing Sheets

[Fig. 1]
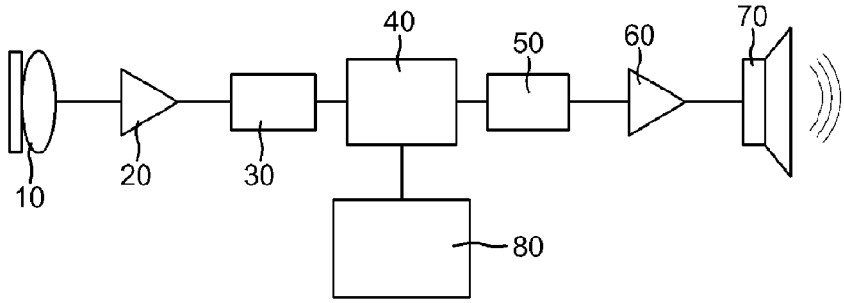
[Fig. 2]
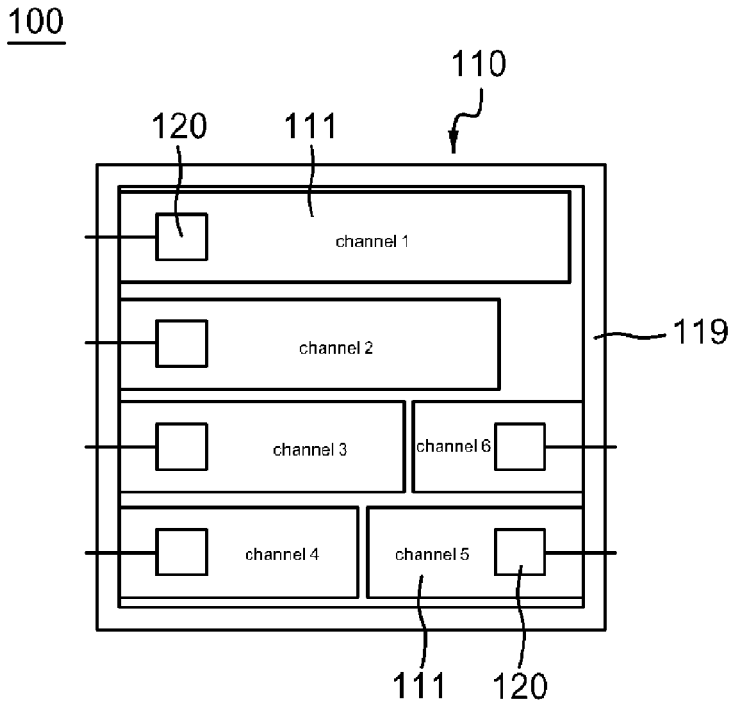
[Fig. 3]
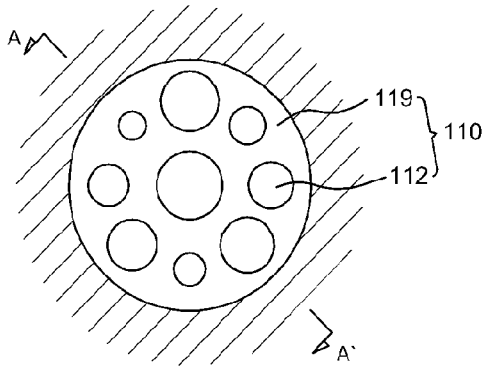
[Fig. 4]
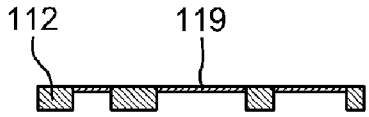
A-A`

[Fig. 5]
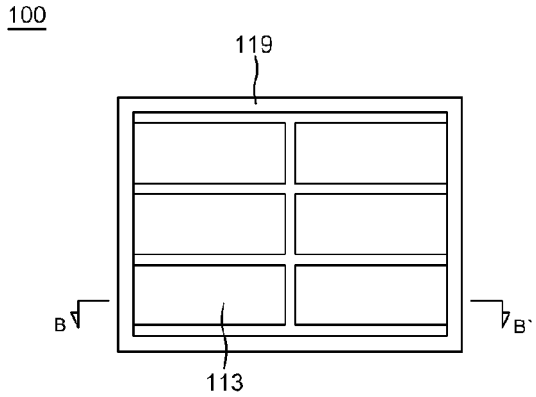
[Fig. 6]
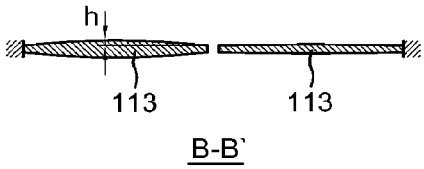
[Fig. 7]
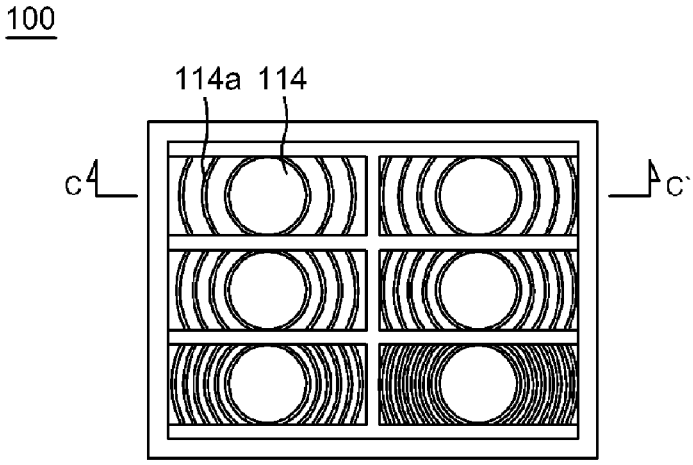
[Fig. 8]
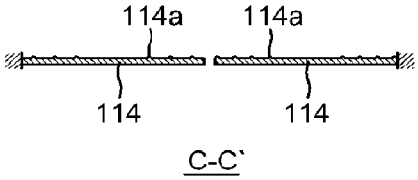
[Fig. 9]
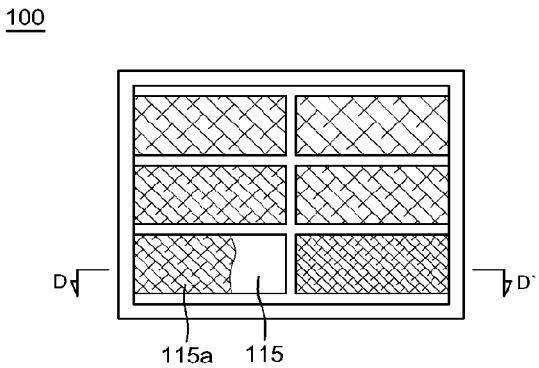

[Fig. 10]
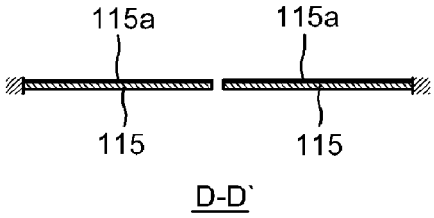
[Fig. 11]
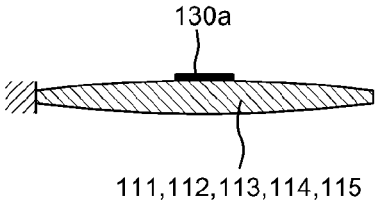
[Fig. 12]
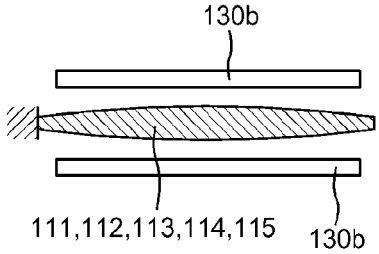
[Fig. 13]
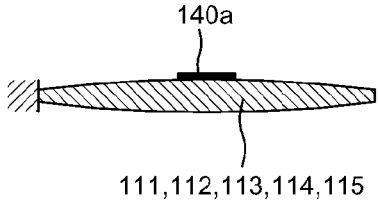
[Fig. 14]
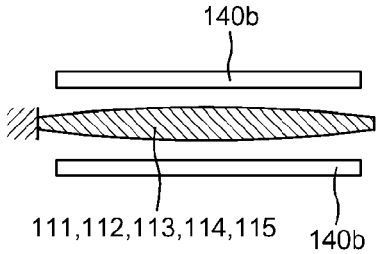
[Fig. 15]
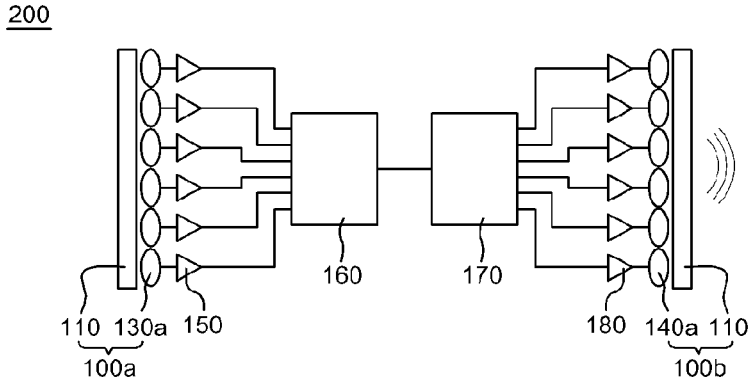

[Fig. 16]
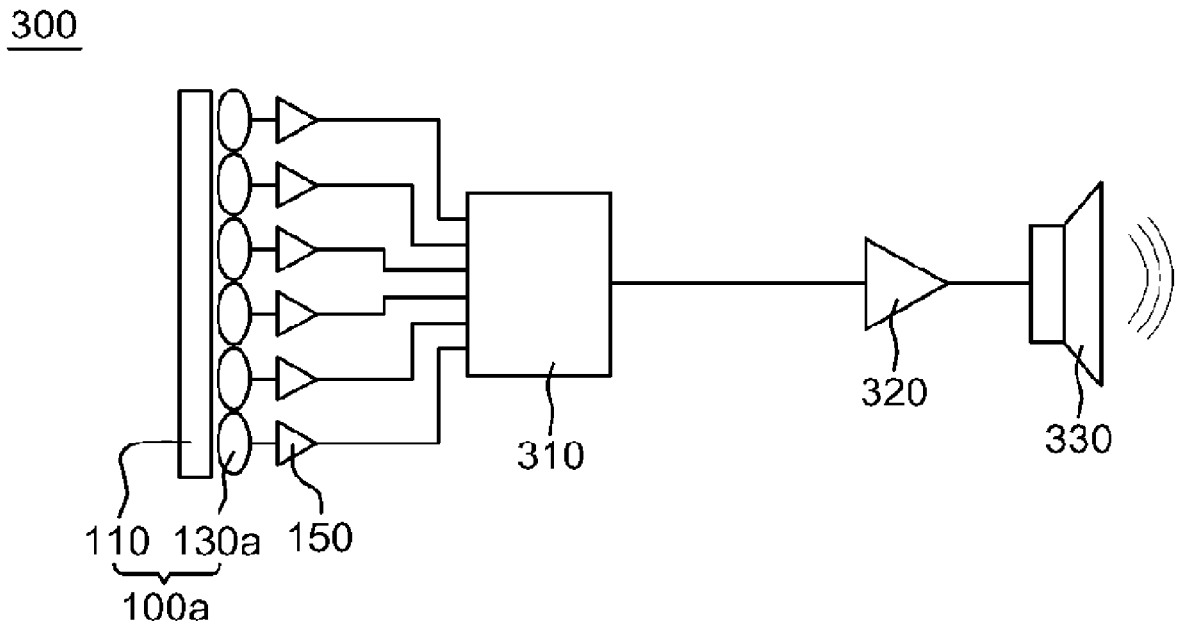
[Fig. 17]
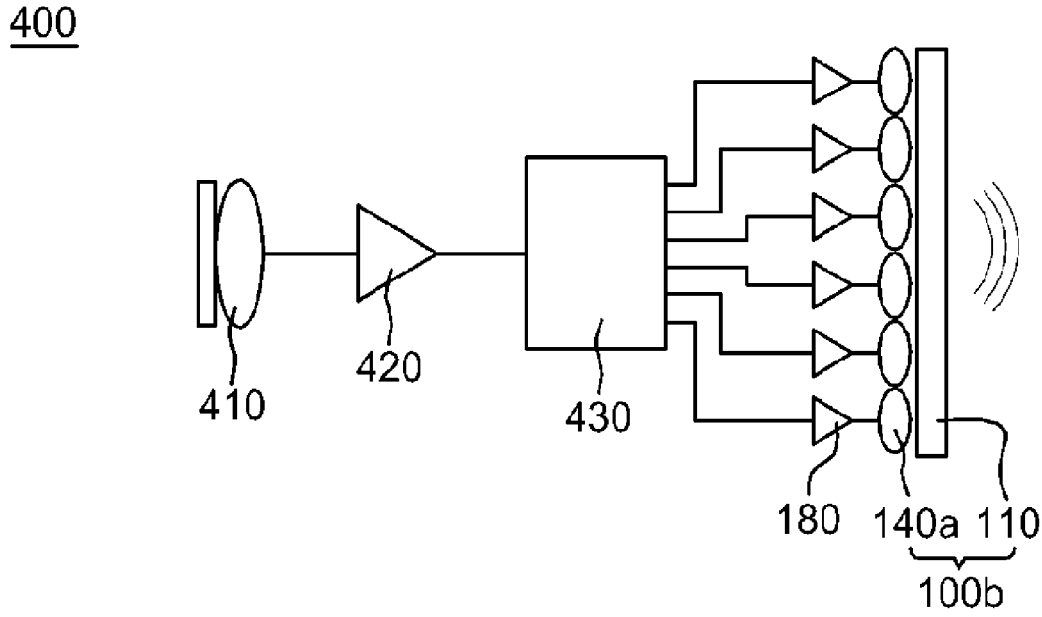

ELECTROACOUSTIC TRANSDUCER HAVING MULTI-CHANNEL DIAPHRAGM AND HEARING AID USING THE SAME

TECHNICAL FIELD

The present invention relates, in general, to a microphone and microspeaker having a multi-channel diaphragm, and a hearing aid using the microphone and microspeaker and, more particularly, to a microphone and microspeaker, which are each constructed using a diaphragm in which an audible frequency range for human beings is divided into one or more frequency bands, and a plurality of channels using the center frequencies of respective divided frequency bands as resonant frequencies is provided, and a hearing aid using the microphone and the microspeaker.

BACKGROUND ART

Generally, a hearing aid is a device which is worn in the ear to supplement hearing ability and is operated to compensate for a user's hearing difficulty by converting an acoustic signal into an electrical signal, by amplifying the electrical signal and by converting the amplified electrical signal into an acoustic signal. As an electroacoustic device for converting an acoustic signal into an electrical signal or converting an electrical signal into an acoustic signal in this way, a microphone and a microspeaker are provided.

FIG. 1 illustrates the construction of a conventional hearing aid. Referring to FIG. 1, a conventional hearing aid includes a microphone 10 for outputting an electrical signal corresponding to a sound wave, a first amplification unit 20 for amplifying a signal output from the microphone 10, an Analog/Digital (A/D) conversion unit 30 for converting the amplified signal into a digital signal, a digital signal processing unit 40 for processing the digital signal output from the A/D conversion unit 30 as a predetermined signal suitable for the wearer of the hearing aid by operating a control program adjusted according to each frequency band for the wearer of the hearing aid, a Digital/Analog (D/A) conversion unit 50 for converting the digital signal output from the digital signal processing unit 40 into an analog signal, a second amplification unit 60 for amplifying the analog signal output from the D/A conversion unit 50, and a microspeaker 70 for outputting the signal amplified by the second amplification unit 60 into an acoustic signal. In the drawing, reference numeral 80, not described, denotes memory and an interface.

Meanwhile, each of the microphone and the microspeaker is provided with a diaphragm for converting an acoustic signal into an electrical signal, or converting an electrical signal into an acoustic signal. Since a conventional diaphragm has a structure having a uniform thickness, and does not satisfy different frequency characteristics for respective persons, the use of the A/D conversion unit for dividing an audible frequency range into a plurality of channels depending on the characteristics of wearers and individually performing amplification and control, the digital signal processing unit for performing a large quantity of computation, the D/A conversion unit, etc. is required, as described above. As a result, there is a problem in that power consumption increases somewhat, so the user of the hearing aid must frequently change the battery thereof.

DISCLOSURE OF INVENTION

Technical Problem

Accordingly, the present invention has been made keeping in mind the above problems, and an object of the present invention is to provide an electroacoustic transducer having a multi-channel diaphragm, and a hearing aid using the electroacoustic transducer, in which a plurality of channels having different resonant frequencies is formed in the diaphragm using Micro-Electro-Mechanical Systems (MEMS) technology, thus more closely approximating the different audible frequency characteristics of respective persons, and consequently increasing the users' satisfaction.

Another object of the present invention is to provide a hearing aid, which does not require a digital signal processing circuit that consumes a lot of power in order to perform filtering, amplification or attenuation of acoustic signals for respective frequency bands, and which utilizes the resonance phenomenon of a diaphragm produced using MEMS technology to reduce relative power consumption, thus minimizing the inconvenience of changing a battery.

Technical Solution

In order to accomplish the above objects and to remove conventional disadvantages, the present invention provides an electroacoustic transducer having a multi-channel diaphragm, comprising a diaphragm provided with a plurality of channels having different resonant frequencies; and a plurality of signal conversion units attached to surfaces of respective channels, or arranged to be spaced apart from the surfaces of the channels at a predetermined interval, thus converting vibration received from respective channels into acoustic signals, or transmitting acoustic signals to the diaphragm and converting the acoustic signals into vibration.

Further, the present invention provides a hearing aid using an electroacoustic transducer having a multi-channel diaphragm, comprising a microphone-type electroacoustic transducer comprising a diaphragm, which is provided with a plurality of channels having different shapes so as to have different resonant frequencies, and a plurality of sensing devices, which are attached to surfaces of respective channels, or are arranged to be spaced apart from the surfaces of the channels at a predetermined interval, the sensing devices generating electrical signals in response to vibration of the channels; a plurality of first amplifiers connected to respective sensing devices, thus amplifying electrical signals output from the sensing devices; a first multiplexer for receiving the signals amplified by the first amplifiers and outputting only electrical signals corresponding to a selected frequency band; a second multiplexer for reselecting and outputting a frequency band of the electrical signals selected by and output from the first multiplexer; a plurality of second amplifiers connected to the second multiplexer and adapted to amplify an electrical signal output from the first multiplexer; and a microspeaker-type electroacoustic transducer comprising another diaphragm, which is provided with a plurality of channels having different shapes so as to have different resonant frequencies, and a plurality of actuator devices, which is attached to surfaces of respective channels, or is arranged to be spaced apart from surfaces of the channels at a predetermined interval, the actuator devices vibrating respective channels using applied electrical signals.

Further, the present invention provides a hearing aid using an electroacoustic transducer having a multi-channel diaphragm, comprising a microphone-type electroacoustic transducer comprising a diaphragm, which is provided with a plurality of channels having different shapes so as to have different resonant frequencies, and a plurality of sensing devices, which are attached to surfaces of respective channels, or are arranged to be spaced apart from the surfaces of the channels at a predetermined interval, the sensing devices generating electrical signals in response to vibration of the channels; a plurality of first amplifiers connected to respective sensing devices, thus amplifying electrical signals output from the sensing devices; a multiplexer for receiving the signals amplified by the first amplifiers and outputting only an electrical signal corresponding to a selected frequency band; a second amplifier connected to the multiplexer and adapted to amplify the electrical signal output from the multiplexer; and a speaker connected to the second amplifier and adapted to convert the amplified electrical signal into an acoustic signal.

Further, the present invention provides a hearing aid using an electroacoustic transducer having a multi-channel diaphragm, comprising a microphone for outputting electrical signals corresponding to sound waves; a first amplifier for amplifying the electrical signals output from the microphone; a multiplexer for receiving the signals amplified by the first amplifier and outputting only an electrical signal corresponding to a selected frequency band; a plurality of second amplifiers connected to the multiplexer and adapted to amplify the electrical signal output from the multiplexer; and a microspeaker-type electroacoustic transducer comprising a diaphragm, which is provided with a plurality of channels having different shapes so as to have different resonant frequencies, and a plurality of actuator devices, which are attached to surfaces of respective channels, or are arranged to be spaced apart from surfaces of the channels at a predetermined interval, the actuator devices vibrating respective channels using applied electrical signals.

ADVANTAGEOUS EFFECTS

As described above, the present invention constructs an electroacoustic transducer using a diaphragm which has a plurality of channels reacting in different frequency bands, so that the transducer can be variously constructed depending on the hearing characteristics of respective persons, and, furthermore, a customized electroacoustic transducer suitable for hearing frequency characteristics of persons can be constructed. Moreover, if a hearing aid is constructed using the above-described electroacoustic transducer, the construction of a circuit for processing signals depending on the hearing characteristics of persons is not necessary, thus simplifying the construction of the hearing aid and realizing a low power design.

BRIEF DESCRIPTION OF THE DRAWINGS

FIG. 1 is a diagram showing the construction of a conventional hearing aid;

FIG. 2 is a diagram showing the construction of an electroacoustic transducer according to a first embodiment of the present invention;

FIGS. 3 to 10 are diagrams showing other constructions of the diaphragm of FIG. 2;

FIGS. 11 and 12 are sectional views showing a microphone-type electroacoustic transducer according to the present invention;

FIGS. 13 and 14 are sectional views showing a microspeaker-type electroacoustic transducer according to the present invention;

FIG. 15 is a diagram showing the construction of a hearing aid according to a second embodiment of the present invention;

FIG. 16 is a diagram showing the construction of a hearing aid according to a third embodiment of the present invention; and FIG. 17 is a diagram showing the construction of a hearing aid according to a fourth embodiment of the present invention.

DESCRIPTION OF REFERENCE CHARACTERS OF IMPORTANT PARTS

100: electroacoustic transducer
100*a*: microphone-type electroacoustic transducer
100*b*: microspeaker-type electroacoustic transducer
110: diaphragm
111, 112, 113, 114, 115: channel
114*a*: rigidity adjustment unit 115*a*: attenuating material
120: signal conversion unit 130: sensing device
140: fixed electrode 150: first amplifier
160: first multiplexer 170: second multiplexer
180: second amplifier

BEST MODE FOR CARRYING OUT THE INVENTION

Hereinafter, embodiments of the present invention will be described in detail with reference to the attached drawings. Detailed descriptions may be omitted if it is determined that the detailed descriptions of related well-known functions and construction may make the gist of the present invention unclear when the present invention is described.

FIG. 2 is a diagram of an electroacoustic transducer 100 having a multi-channel diaphragm according to a first embodiment of the present invention. Referring to FIG. 2, the electroacoustic transducer 100 includes a multi-channel diaphragm 110 and a plurality of signal conversion units 120. The multi-channel diaphragm 110 is constructed so that a plurality of channels 111 having different thicknesses or shapes so as to have different resonant frequencies is formed on the top or sides of a support 119. Each channel 111 formed in the support 119 in this way functions as a single acoustic filter, acoustic amplifier or acoustic attenuator, thus simplifying the construction of a circuit for transmitting an acoustic signal in the air to the channels 111 or transmitting a vibration signal from the channels 111 to the air. Meanwhile, the resonant frequency, frequency band and attenuation constant (Q-factor) of each channel 111 are determined according to the result of measurement of the hearing ability of a user. An audible frequency range is divided by the number of channels 111, and the center frequencies of respective divided frequency bands are set to the resonant frequencies of respective channels 111.

Meanwhile, the resonant frequency of each channel 111 can be implemented by varying the structure of the channel 111. That is, as shown in FIG. 2, the channels 111 can be constructed using an arrangement of fine beam structures spaced apart from each other at a predetermined interval. In this case, the fine beam structures are formed to have different shapes. In this way, the shapes of the fine beam structures, that is, the thicknesses or sizes thereof, are differently set depending on locations, thus the resonant frequencies of the fine beam structures can be differently set.

FIGS. 3 to 10 are diagrams showing other constructions of the channels of the diaphragm. Referring to FIGS. 3 and 4, the channels 112 of the diaphragm 110 can be constructed so that the diaphragm 110 is divided into a certain number of parts to cause respective divided parts to have different sizes. Accordingly, respective parts, that is, respective channels 112, have different resonant frequencies due to the difference in mass.

The diaphragm can be constructed so that only part of each channel 111 can be fixed to a support 119, as shown in FIG. 2, or so that the entire circumference of each channel 112 can be fixed to the support 119, as shown in FIG. 3.

Referring to FIGS. 5 and 6, the channels 113 of the diaphragm 110 can be constructed using an arrangement of fine beam structures spaced apart from each other at a predetermined interval. In this case, the fine beam structures are formed such that center portions thereof are thicker or thinner than circumferential portions thereof. That is, of the plurality of fine beam structures, a predetermined number of fine beam structures are formed to cause center portions thereof to be thicker than the circumferential portions thereof, and the remaining fine beam structures are formed to cause center portions thereof to be identical to or thinner than the circumferential portions thereof. Of course, all of the fine beam structures can be formed to cause center portions thereof to be thicker than circumferential portions thereof. In contrast, all of the fine beam structures can be formed to cause center portions thereof to be thinner than circumferential portions thereof. However, even in the case of the fine beam structures, center portions of which are formed to be thicker or thinner than circumferential portions thereof, the differences in mass between the fine beam structures are induced by adjusting the difference in thickness (h) therebetween, thus the resonant frequencies of the fine beam structures can be differently set.

Further, referring to FIGS. 7 and 8, the channels 114 of the diaphragm 110 can be constructed using an arrangement of fine beam structures spaced apart from each other at a predetermined interval. In this case, each fine beam structure is formed such that a plurality of rigidity adjustment units 114*a*, each having a protruding or depressed shape as well as a concentric structure, is formed to be spaced apart from each other at a predetermined interval in a range from the center portion of the fine beam structure to the end of the circumferential portion thereof. Meanwhile, in FIG. 8, rigidity adjustment units 114*a*, each having a protruding shape, are shown. The sizes or intervals of the rigidity adjustment units 114*a* are adjusted, thus the rigidity of the fine beam structures is adjusted. The resonant frequencies of the fine beam structures can be differently set through the adjustment of rigidity.

Further, referring to FIGS. 9 and 10, the channels 115 of the diaphragm 110 can be constructed using an arrangement of fine beam structures spaced apart from each other at a predetermined interval. In this case, the surfaces of the fine beam structures are coated with predetermined attenuating materials 115*a* so that coated thicknesses are different from each other. The thicknesses of the attenuating materials 115*a* applied on the fine beam structures are differently set, thus the resonant frequency, frequency band and attenuation constant (Q-factor) of the fine beam structures can be differently set. For the attenuating materials 115*a*, polymer or urethane can be used.

The channels 111, 112, 113, 114 and 115 of the above-described diaphragm 110 having various structures can be produced through MEMS technology, which is used to implement a subminiature mechanical-electronic system.

Meanwhile, the electroacoustic transducer 100 can be classified into a microphone-type electroacoustic transducer, which converts vibration occurring in the diaphragm 110 into an acoustic signal by using sensing devices as the signal conversion units 120, and a microspeaker-type electroacoustic transducer, which converts an externally applied electrical signal into the vibration of the diaphragm 110 by using actuator devices as the signal conversion units 120, and thus generates sound.

FIGS. 11 and 12 are diagrams showing a microphone-type electroacoustic transducer. Referring to FIGS. 11 and 12, as a sensing device 130*a* or 130*b* provided in the microphone-type electroacoustic transducer, a piezoelectric device 130*a*, which is attached to the surface of each channel 111, 112, 113, 114 or 115 provided in the diaphragm 110 and which is adapted to convert the vibration of the channel, vibrating in response to an external acoustic signal, into an electrical signal, or a capacitance sensor 130*b*, which is spaced apart from one or both surfaces of each channel 111, 112, 113, 114 or 115 at a predetermined interval and which is adapted to convert variation in capacitance, occurring due to the difference between intervals caused by the vibration of the channel, into variation in voltage, can be used.

FIGS. 13 and 14 are diagrams of the microspeaker-type electroacoustic transducer. Referring to FIGS. 13 and 14, as an actuator device 140*a* or 140*b* provided in the microspeaker-type electroacoustic transducer, a piezoelectric device 140*a*, which is attached to the surface of each channel 111, 112, 113, 114 or 115 provided in the diaphragm 110 and which is adapted to convert an externally applied electrical signal into the vibration of the channel, or an electrode 140*b*, which is arranged to be spaced apart from one or both surfaces of each channel 111, 112, 113, 114 or 115 at a predetermined interval and which is adapted to vibrate the channel using an applied electrical signal, can be used.

The above-described diaphragm 110, sensing devices 130*a* or 130*b*, and a signal processing circuit for amplifying or processing electrical signals can be manufactured to be integrated on a single semiconductor chip using MEMS technology, or can be implemented in the form of a single chip package included in a single semiconductor package. Similar to this, the diaphragm 110, the actuator devices 140*a* or 140*b*, and a signal processing circuit for amplifying or processing electrical signals can be formed to be integrated on a single semiconductor chip, or can be manufactured in the form of a single chip package.

FIG. 15 is a diagram showing a hearing aid according to a second embodiment of the present invention. Referring to FIG. 15, a hearing aid 200 according to the second embodiment of the present invention includes the above-described microphone-type electroacoustic transducer 100*a*, a plurality of first amplifiers 150, a first multiplexer 160, a second multiplexer 170, a plurality of second amplifiers 180, and the above-described microspeaker-type electroacoustic transducer 100*b*. Such a hearing aid uses the microphone-type electroacoustic transducer 100*a*, which exploits MEMS technology for minimizing power consumption to correct hearing frequency characteristics, and the microspeaker-type electroacoustic transducer 100*b* using MEMS technology, so that a digital signal processing system for operating complicated formulas requiring considerably high power consumption is not required, thus a simpler construction is enabled and a construction having low power consumption is also enabled.

That is, the microphone-type electroacoustic transducer 100*a* has various frequency characteristics due to the diaphragm 110, in which a plurality of channels having different resonant frequencies is provided, so that a conventional digital signal processing system for correcting frequency characteristics is not necessary, thus enabling the construction of a low power hearing aid.

When a sound wave is transmitted to the diaphragm 110, the above-described microphone-type electroacoustic transducer 100*a* vibrates while a channel, having a resonant frequency corresponding to the frequency band of the corresponding sound wave, reacts to the sound wave. In this case, the sensing device 130*a* or 130*b* attached to the channel generates an electrical signal.

The plurality of first amplifiers 150 is connected to the sensing devices 130*a* or 130*b* provided in the microphone-type electroacoustic transducer 100*a* in a one-to-one correspondence manner, and amplifies electrical signals output from the sensing devices 130*a* or 130*b*.

The first multiplexer 160 is connected to the first amplifiers 150 to receive the electrical signals amplified by the first amplifiers 150, and to output only electrical signals corresponding to a frequency band selected through the user's manipulation. At this time, one or more electrical signals can be selected. Therefore, the frequency band of the multiplexer is set depending on the result of examination of the hearing ability of the user.

The second multiplexer 170 and the second amplifiers 180 are sequentially connected to the first multiplexer 160, and are adapted to amplify and output the electrical signals output from the first multiplexer 160.

The microspeaker-type electroacoustic transducer 100*b* converts the electrical signals transmitted from the second amplifier 180 into acoustic signals, and thus outputs sound, which the user can hear. The microspeaker-type electroacoustic transducer 100*b* was described in detail above, so a detailed description thereof is omitted.

FIG. 16 is a diagram showing a hearing aid according to a third embodiment of the present invention. Referring to FIG. 16, a hearing aid 300 according to the third embodiment of the present invention includes the above-described microphone-type electroacoustic transducer 100*a*, a plurality of first amplifiers 150, a multiplexer 310, a second amplifier 320, and a speaker 330.

The microphone-type electroacoustic transducer 100*a* and the first amplifiers 150 have the same construction as the microphone-type electroacoustic transducer and the first amplifiers of the second embodiment, so a detailed description thereof is omitted, and the same reference numerals are used.

The multiplexer 310 is connected to the first amplifiers 150 to receive electrical signals amplified by the first amplifiers 150, and to output only an electrical signal corresponding to a frequency band selected through the user's manipulation.

The second amplifier 320 amplifies the signal output from the multiplexer 310, and the speaker 330 converts the electrical signal amplified by the second amplifier 320 into acoustic signals.

FIG. 17 is a diagram showing a hearing aid according to a fourth embodiment of the present invention. Referring to FIG. 17, a hearing aid 400 according to the fourth embodiment of the present invention includes a microphone 410, a first amplifier 420, a multiplexer 430, a plurality of second amplifiers 180, and a microspeaker-type electroacoustic transducer 100*b*. Such a hearing aid 400 is constructed to convert electrical signals, converted by the microphone 410 having a single channel, into sound through the microspeaker-type electroacoustic transducer 100*b* having a multichannel diaphragm, and to output the sound.

The microphone 410 is adapted to convert sound waves into electrical signals and to output the electrical signals, and uses a diaphragm having a single channel, similar to a conventional microphone. Such a microphone 410 is well-known technology, so a detailed description thereof is omitted.

The first amplifier 420 is constructed to amplify the electrical signals output from the microphone 410.

The multiplexer 430 is constructed to receive the signals amplified by the first amplifier 420, and to output only an electrical signal corresponding to a selected frequency band.

As the second amplifiers 180, a plurality of second amplifiers can be provided in order to differently amplify the electrical signal output from the multiplexer 430 for respective frequency bands.

The microspeaker-type electroacoustic transducer 100*b* has the same construction as the microspeaker-type electroacoustic transducer of the second embodiment, and thus a detailed description thereof is omitted.

Those skilled in the art will appreciate that the present invention is not limited to the above-described specific embodiments, that various modifications are possible without departing from the scope and spirit of the invention as disclosed in the accompanying claims, and that such modifications belong to the scope of the description of the claims.

The invention claimed is:

1. An electroacoustic transducer having a multi-channel diaphragm, comprising:

a diaphragm provided with a plurality of channels having different resonant frequencies; and a plurality of signal conversion units attached to surfaces of respective channels, or arranged to be spaced apart from the surfaces of the channels at a predetermined interval, thus converting vibration received from respective channels into acoustic signals, or transmitting acoustic signals to the diaphragm and converting the acoustic signals into vibration.

2. The electroacoustic transducer according to claim 1, wherein the channels of the diaphragm are constructed so that the diaphragm is divided into a certain number of parts, and respective divided parts are formed to have different thicknesses.

3. The electroacoustic transducer according to claim 1, wherein:

the channels of the diaphragm are constructed so that a plurality of fine beam structures spaced apart from each other at a predetermined interval is arranged, and the fine beam structures are formed such that center portions thereof are thinner or thicker than circumferential portions thereof, thus resonant frequencies of the channels are set to be suitable for hearing characteristics of respective users through adjustment of mass of each fine beam structure.

4. The electroacoustic transducer according to claim 1, wherein:

the channels of the diaphragm are constructed so that a plurality of fine beam structures spaced apart from each other at a predetermined interval is arranged, and each fine beam structure is formed such that a plurality of rigidity adjustment units, each having a protruding or depressed shape as well as a concentric structure, is formed to be spaced apart from each other at a predetermined interval in a range from a center portion of the fine beam structure to an end of a circumferential portion thereof, thus resonant frequencies of the channels are set to be suitable for hearing characteristics of respective users through adjustment of rigidity of each fine beam structure.

5. The electroacoustic transducer according to claim 1, wherein:

the channels of the diaphragm are constructed so that a plurality of fine beam structures spaced apart from each other at a predetermined interval is arranged, and the fine beam structures have different shapes, thus resonant frequencies of the channels are set to be suitable for hearing characteristics of respective users.

6. The electroacoustic transducer according to claim 1, wherein:

the channels of the diaphragm are constructed so that a plurality of fine beam structures spaced apart from each other at a predetermined interval is arranged, and the fine beam structures are formed such that surfaces thereof are coated with attenuating materials having predetermined thicknesses, thus resonant frequencies, frequency bands, and attenuation constants (Q-factors) of the channels are set to be suitable for hearing characteristics of users through adjustment of attenuation characteristics of each fine beam structure.

7. The electroacoustic transducer according to claim 1, wherein the channels of the diaphragm are constructed so that an audible frequency range of human beings is divided into a predetermined number of channels, and center frequencies of respective divided frequency bands are set to resonant frequencies.

8. The electroacoustic transducer according to claim 1, wherein the signal conversion units comprise a plurality of sensing devices attached to surfaces of respective channels of the diaphragm, or arranged to be spaced apart from the surfaces of the channels at a predetermined interval, thus converting vibration of the channels into electrical signals.

9. The electroacoustic transducer according to claim 8, wherein the sensing devices are piezoelectric devices attached to respective channels to generate electrical signals in response to vibration of the channels.

10. The electroacoustic transducer according to claim 8, wherein the sensing devices are capacitance sensing devices in which fixed electrodes are arranged to be spaced apart from one or both surfaces of each of the channels at a predetermined interval, thus inducing vibration of the channels using variation in interval between the channels and the fixed electrodes, and consequently converting the vibration into electrical signals proportional to the vibration.

11. The electroacoustic transducer according to claim 1, wherein the signal conversion units comprise a plurality of actuator devices attached to surfaces of respective channels of the diaphragm, or arranged to be spaced apart from the surfaces of the channels at a predetermined interval, thus converting applied electrical signals into vibration of the diaphragm.

12. The electroacoustic transducer according to claim 11, wherein the actuator devices are piezoelectric devices attached to respective channels and adapted to vibrate the diaphragm using applied electrical signals.

13. The electroacoustic transducer according to claim 11, wherein the actuator devices are electrodes arranged to be spaced apart from one or both surfaces of each of the channels at a predetermined interval and adapted to vibrate the diaphragm using applied electrical signals.

14. The electroacoustic transducer according to claim 1, wherein the diaphragm and the signal conversion units are implemented on a single semiconductor chip.

15. The electroacoustic transducer according to claim 1, wherein the diaphragm and the signal conversion units are implemented to be included in a single chip package.

16. A hearing aid using an electroacoustic transducer having a multi-channel diaphragm, comprising:

a microphone-type electroacoustic transducer comprising a diaphragm, which is provided with a plurality of channels having different shapes so as to have different resonant frequencies, and a plurality of sensing devices, which are attached to surfaces of respective channels, or are arranged to be spaced apart from the surfaces of the channels at a predetermined interval, the sensing devices generating electrical signals in response to vibration of the channels;

a plurality of first amplifiers connected to respective sensing devices, thus amplifying electrical signals output from the sensing devices;

a first multiplexer for receiving the signals amplified by the first amplifiers and outputting only electrical signals corresponding to a selected frequency band;

a second multiplexer for reselecting and outputting a frequency band of the electrical signals selected by and output from the first multiplexer;

a plurality of second amplifiers connected to the second multiplexer and adapted to amplify an electrical signal output from the first multiplexer; and a microspeaker-type electroacoustic transducer comprising another diaphragm, which is provided with a plurality of channels having different shapes so as to have different resonant frequencies, and a plurality of actuator devices, which is attached to surfaces of respective channels, or is arranged to be spaced apart from surfaces of the channels at a predetermined interval, the actuator devices vibrating respective channels using applied electrical signals.

17. A hearing aid using an electroacoustic transducer having a multi-channel diaphragm, comprising:

a microphone-type electroacoustic transducer comprising a diaphragm, which is provided with a plurality of channels having different shapes so as to have different resonant frequencies, and a plurality of sensing devices, which are attached to surfaces of respective channels, or are arranged to be spaced apart from the surfaces of the channels at a predetermined interval, the sensing devices generating electrical signals in response to vibration of the channels;

a plurality of first amplifiers connected to respective sensing devices, thus amplifying electrical signals output from the sensing devices;

a multiplexer for receiving the signals amplified by the first amplifiers and outputting only an electrical signal corresponding to a selected frequency band;

a second amplifier connected to the multiplexer and adapted to amplify the electrical signal output from the multiplexer; and a speaker connected to the second amplifier and adapted to convert the amplified electrical signal into an acoustic signal.

18. A hearing aid using an electroacoustic transducer having a multi-channel diaphragm, comprising:

a microphone for outputting electrical signals corresponding to sound waves;

a first amplifier for amplifying the electrical signals output from the microphone;

a multiplexer for receiving the signals amplified by the first amplifier and outputting only an electrical signal corresponding to a selected frequency band;

a plurality of second amplifiers connected to the multiplexer and adapted to amplify the electrical signal output from the multiplexer; and a microspeaker-type electroacoustic transducer comprising a diaphragm, which is provided with a plurality of channels having different shapes so as to have different resonant frequencies, and a plurality of actuator devices, which are attached to surfaces of respective channels, or are arranged to be spaced apart from surfaces of the channels at a predetermined interval, the actuator devices vibrating respective channels using applied electrical signals.

* * * * *